US006321675B1

(12) United States Patent
Dybdahl et al.

(10) Patent No.: US 6,321,675 B1
(45) Date of Patent: Nov. 27, 2001

(54) FLOATING INSTALLATION

(75) Inventors: Svein Dybdahl, Asker; Per Inge Remmen, Nesbru, both of (NO)

(73) Assignee: Ormen Brede AS (NO)

( * ) Notice: Subject to any disclaimer, the term of this patent is extended or adjusted under 35 U.S.C. 154(b) by 0 days.

(21) Appl. No.: 09/581,338

(22) PCT Filed: Dec. 10, 1998

(86) PCT No.: PCT/NO98/00374

§ 371 Date: Jun. 9, 2000

§ 102(e) Date: Jun. 9, 2000

(87) PCT Pub. No.: WO99/29566

PCT Pub. Date: Jun. 17, 1999

(51) Int. Cl.[7] ..... B63B 35/44
(52) U.S. Cl. ..... 114/264; 114/266
(58) Field of Search ..... 114/264, 266

(56) References Cited

U.S. PATENT DOCUMENTS

| | | | | |
|---|---|---|---|---|
| 3,739,736 | | 6/1973 | Carreau et al. | 414/293 |
| 4,069,785 | | 1/1978 | Bordes | 114/47 |
| 4,436,048 | * | 3/1984 | Gentry et al. | 114/230 |
| 4,470,721 | * | 9/1984 | Shotbolt | 114/264 X |
| 4,995,762 | * | 2/1991 | Goldman | 114/264 X |
| 5,135,327 | * | 8/1992 | White et al. | 114/265 X |

FOREIGN PATENT DOCUMENTS

| | | |
|---|---|---|
| 2110602 | 6/1983 | (GB) . |

* cited by examiner

*Primary Examiner*—Janice L. Krizek
(74) *Attorney, Agent, or Firm*—Baker Botts L.L.P.

(57) ABSTRACT

A floating installation, including a main moonpool (1), wherein in the main moonpool (1) there is arranged a bulkhead (4) which divides the moonpool (1) into a first section and a second section. The bulkhead (4) forms a first wall in a compartment (16) in the first section. The compartment (16) is also defined by the walls of the moonpool (I) and a floor (7). The bulkhead (4) is designed to be opened to provide communication between the first section and the second section. The compartment (16) is substantially watertight when the bulkhead (4) is closed.

7 Claims, 16 Drawing Sheets

FLOATING INSTALLATION

The present invention relates to a floating installation in accordance with the preamble in claim 1 below.

Typically, such floating installations are drill and production ships, which have become very common on the continental shelf. They exhibit great advantages over floating platforms, the ships being considerably more flexible, and because of their far greater ability to move, they are highly suitable for use in test drilling and production from smaller fields.

However, drill and production ships are more vulnerable to wind and waves than platforms. They have a higher center of gravity and smaller deck space than platforms.

It is an object of the present invention to provide a drill and production ship which has a considerably lower center of gravity and better utilization of existing deck space.

It is also an object of the present invention to provide the possibility of connecting a greater number of risers to the drill and production ship than has hitherto been possible.

It is also an object of the invention to permit several operations to be carried out simultaneously, such as simultaneous drilling and production from different wells, and the preparation of equipment without disrupting drilling operations and the like.

It is also an object of the invention to free space close to the derrick. More space also permits a larger moonpool to be made than is usual in this type of ship today.

It is also an object to allow the pipe rack to be positioned on the same level as the drill floor and preferably at the same level as the ship's deck.

From U.S. Pat. No. 4,069,785 a ship is known, which comprises a moonpool. A section of the moonpool can be isolated from the sea by a pair of watertight doors to form a dry dock.

A travelling crane is arranged over the moonpool to transport a load between the dry part and the wet part of the moonpool.

Although this reference teaches a dividable moonpool with a dry part and a wet part, the known ship is useless for drilling or production operations. No derrick is present. A derrick is vital for drilling or production operations. Even if a derrick had been present, it would not be possible to use this. The travelling crane would very effectively obstruct the handling of pipes or the like in the derrick. The necessary transfer of, e.g. a BOP, to a suspension in a string of pipe in the derrick is impossible to perform with the travelling crane. The travelling crane cannot bring the BOP into a position under the end of the string of pipe, for connection to this, because the travelling path of the crane and the travelling path of the string of pipe are in conflict with each other.

The above reference teaches a halfway solution which at the best is able to perform as a support ship for a drilling or production installation, but cannot itself perform as a fully equipped drilling or production installation.

The above mentioned objects still remain to be met in a satisfying way. Therefore, the present invention achieves this by the features set forth in the characterising clause of claim 1.

The invention will now be described in more detail with reference to the attached figures, wherein:

FIGS. 11–18 show an example of operations which can be carried out using the drill and production ship according to the present invention, wherein:

Figure 11:
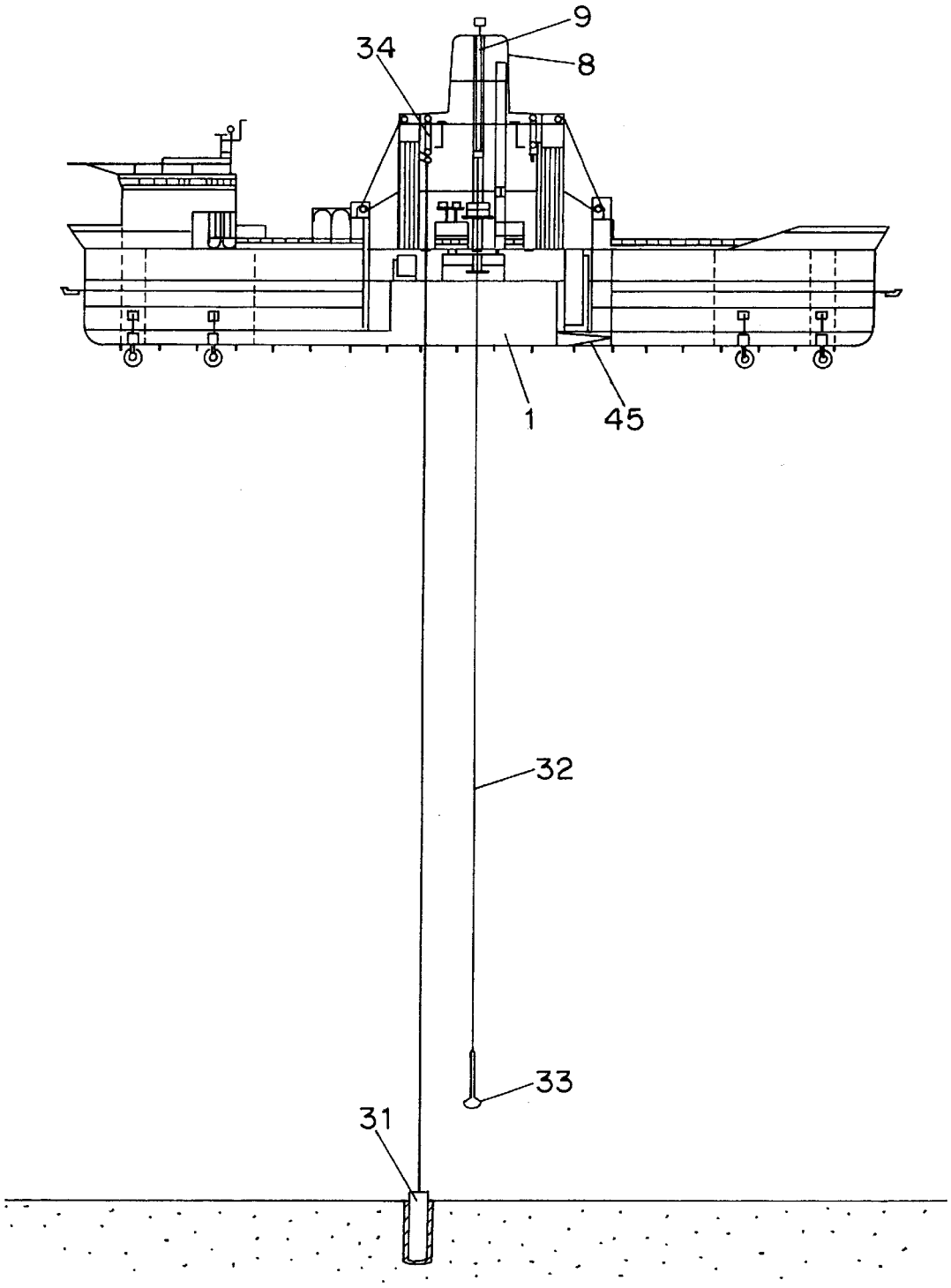
Figure 12:
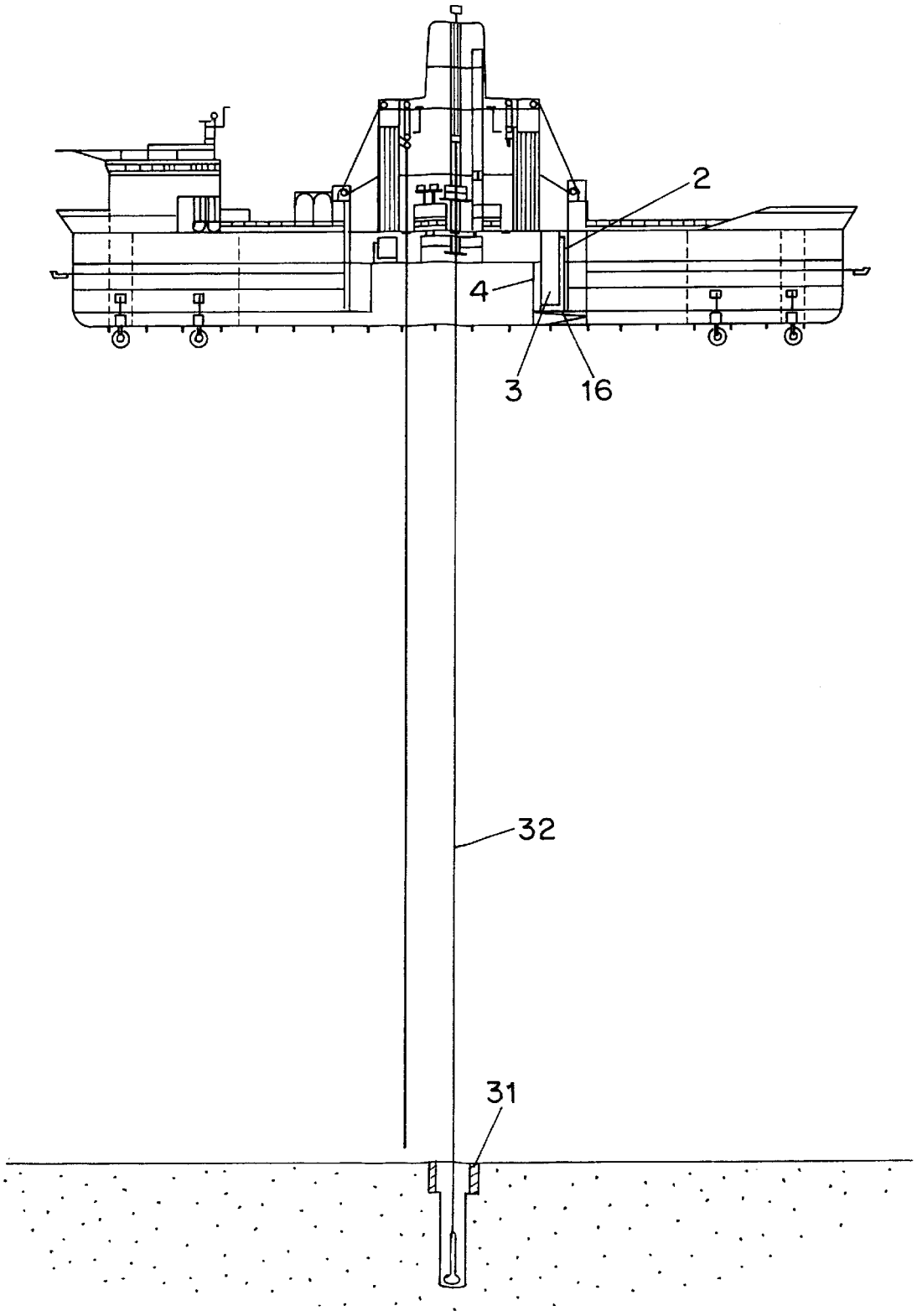
Figure 13:
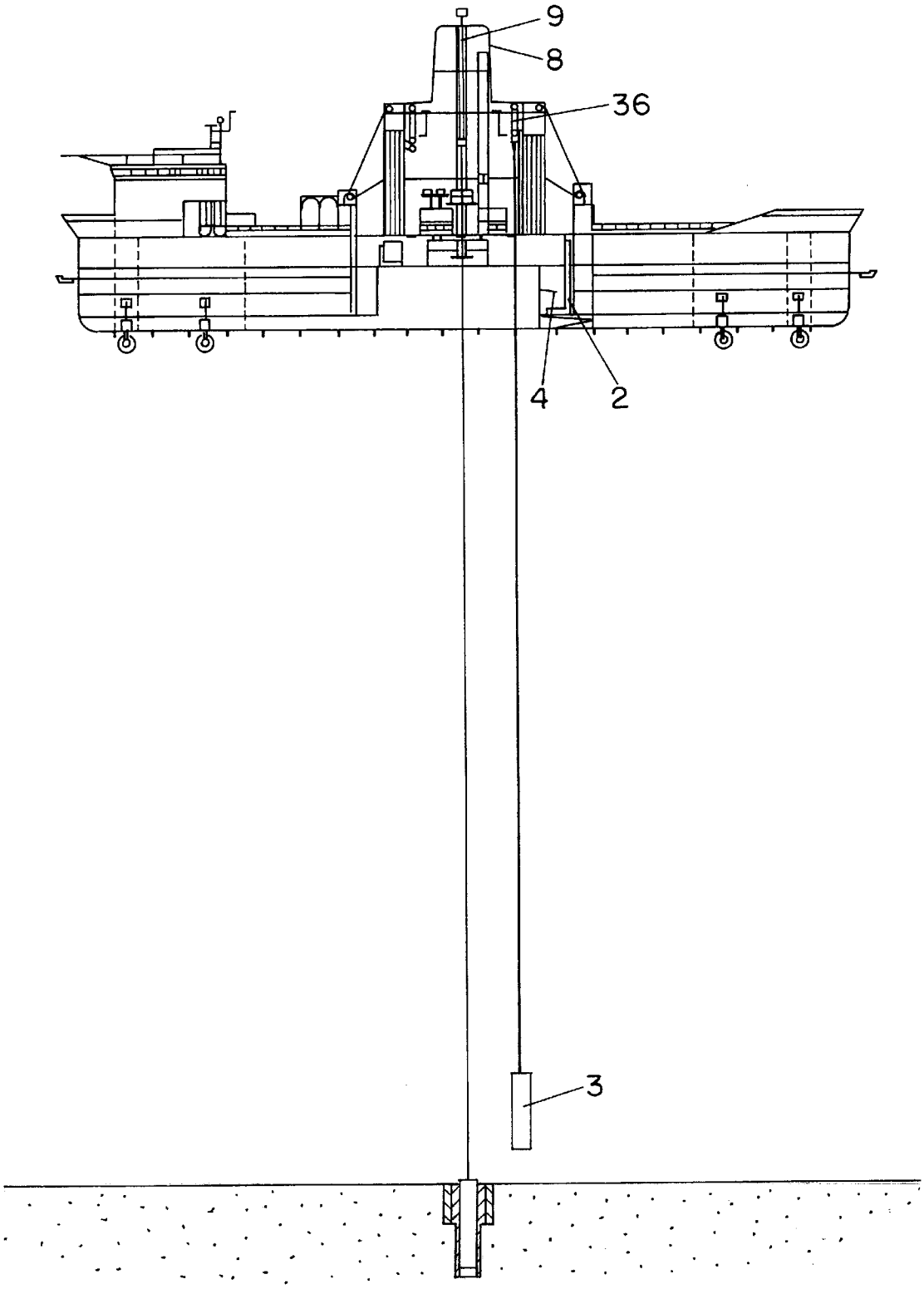
Figure 14:
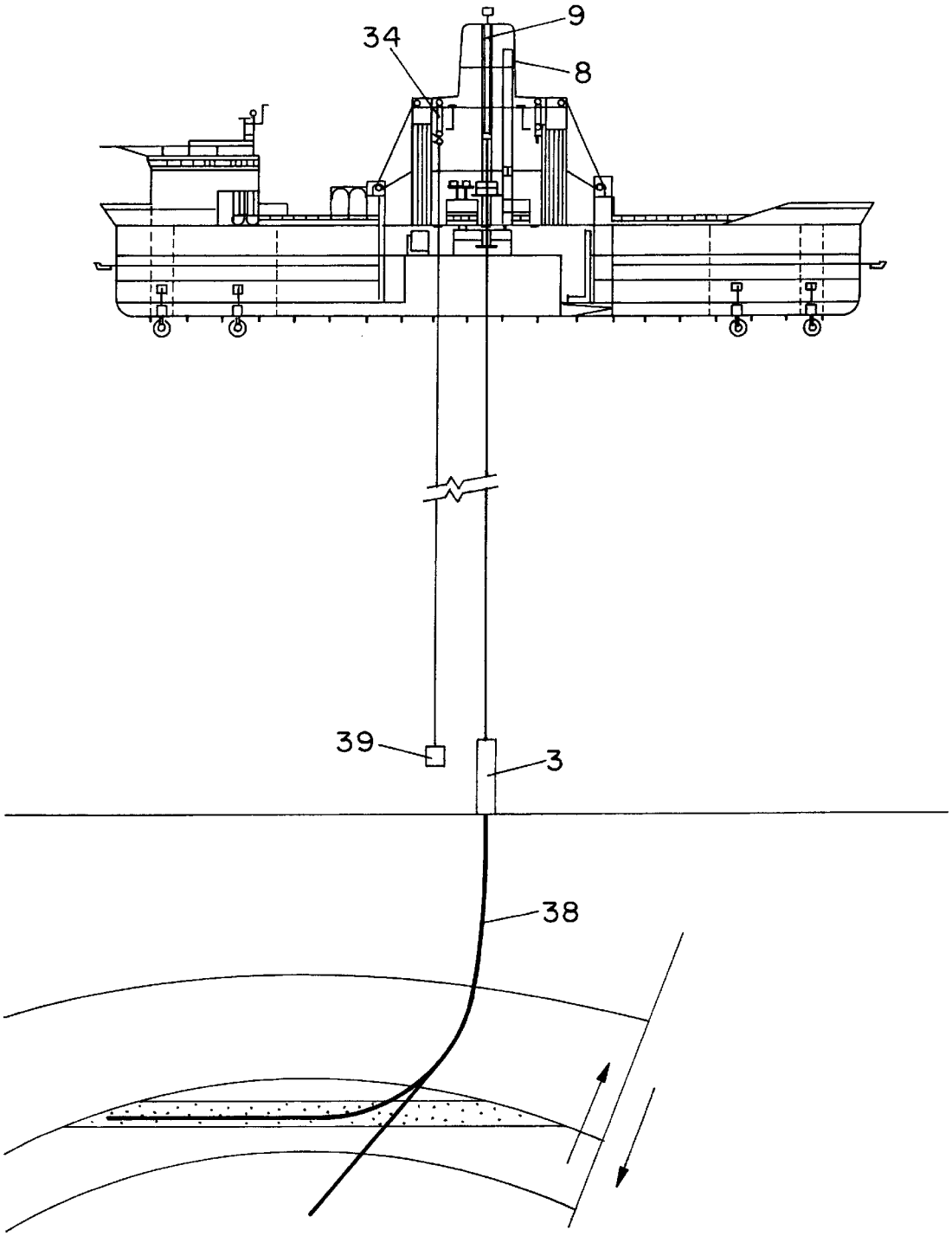
Figure 15:
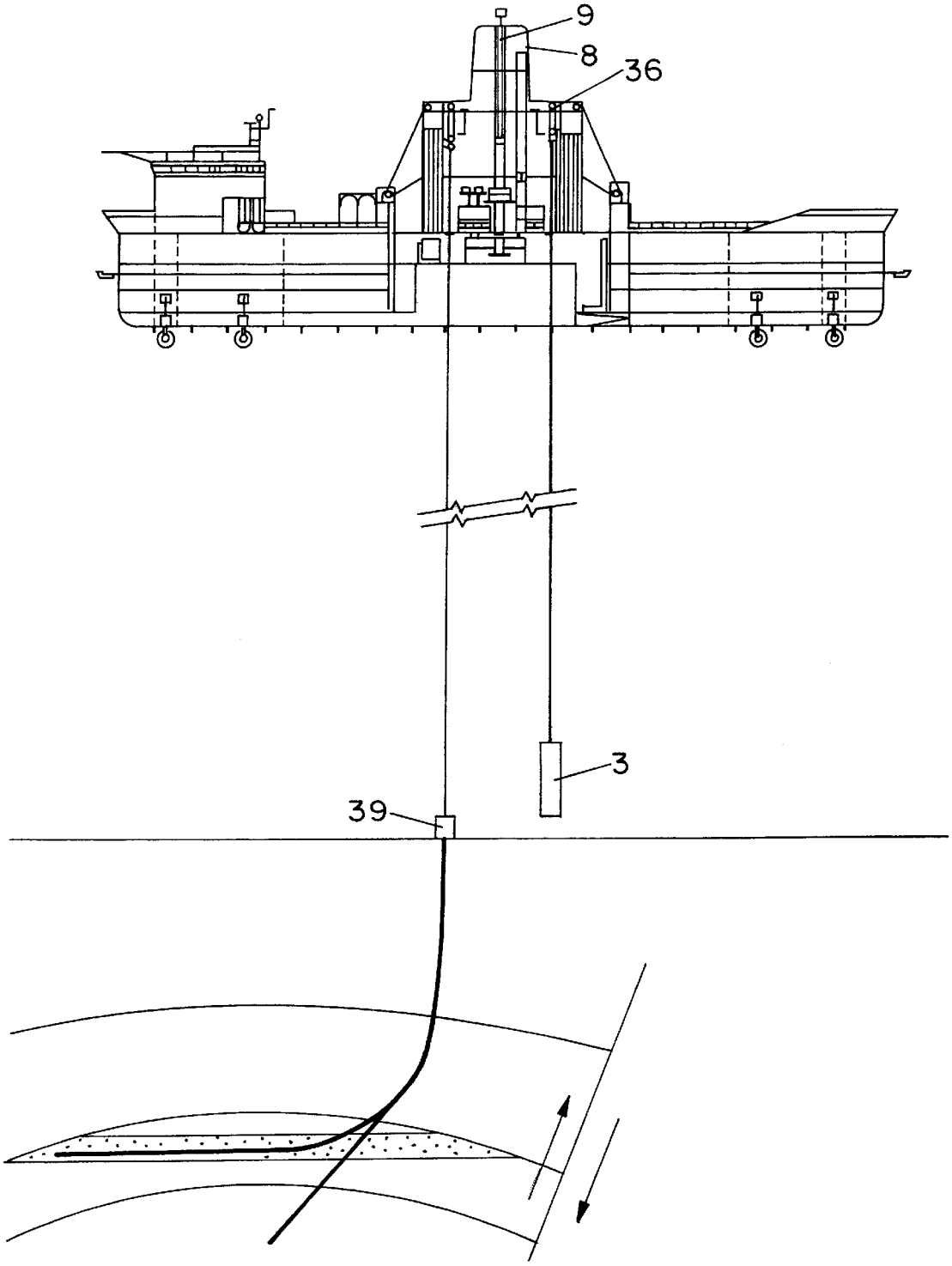
Figure 16:
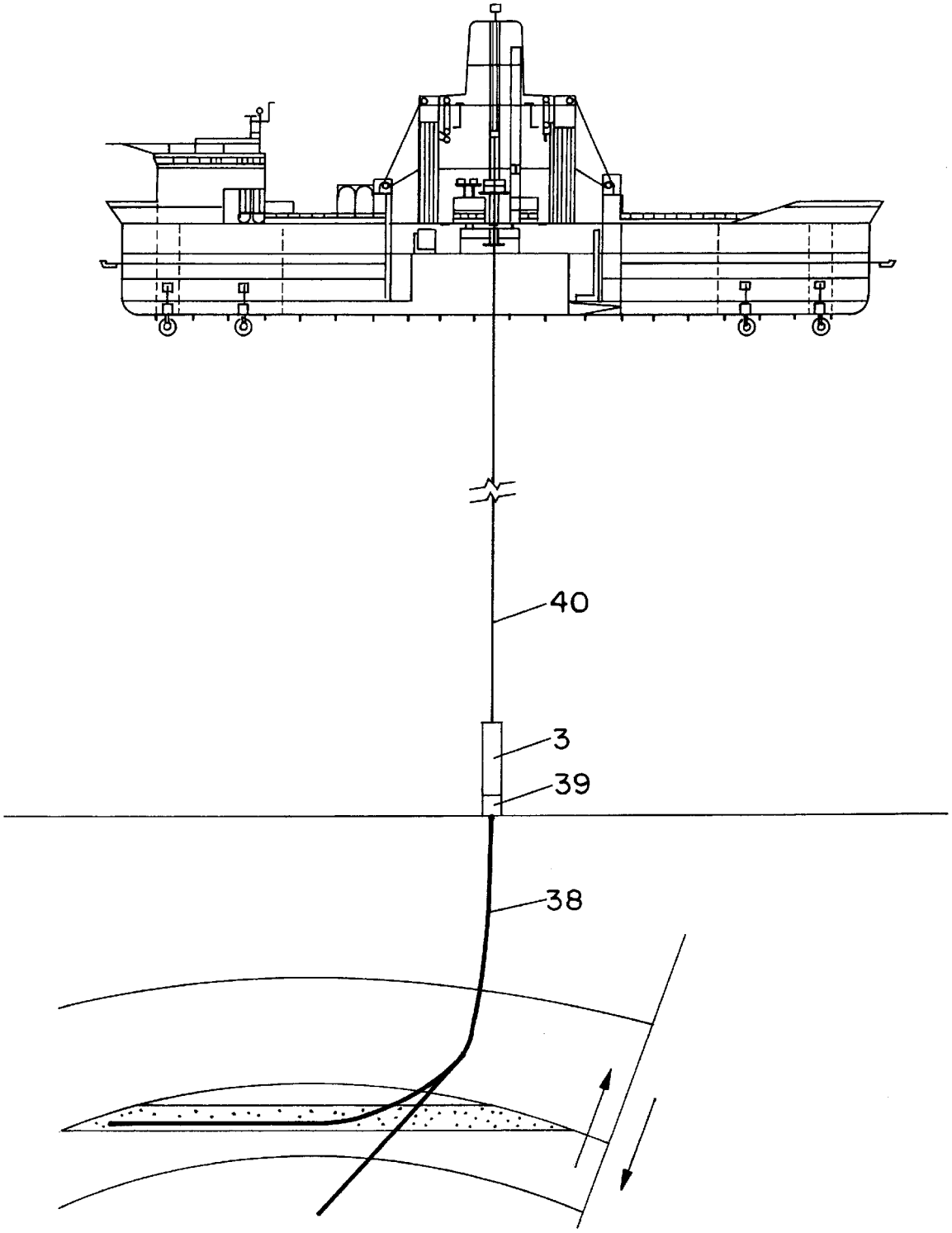
Figure 17:
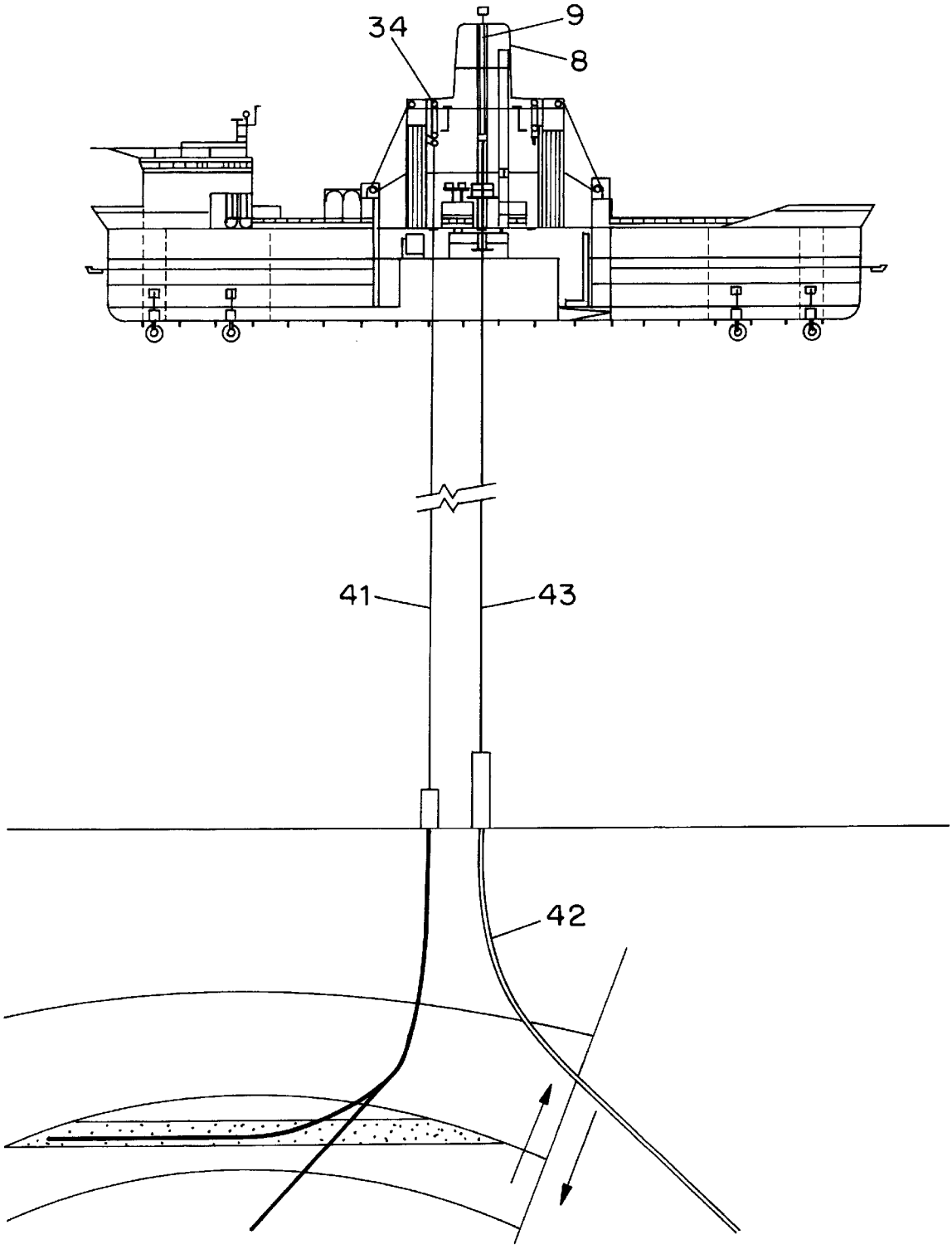
Figure 18:
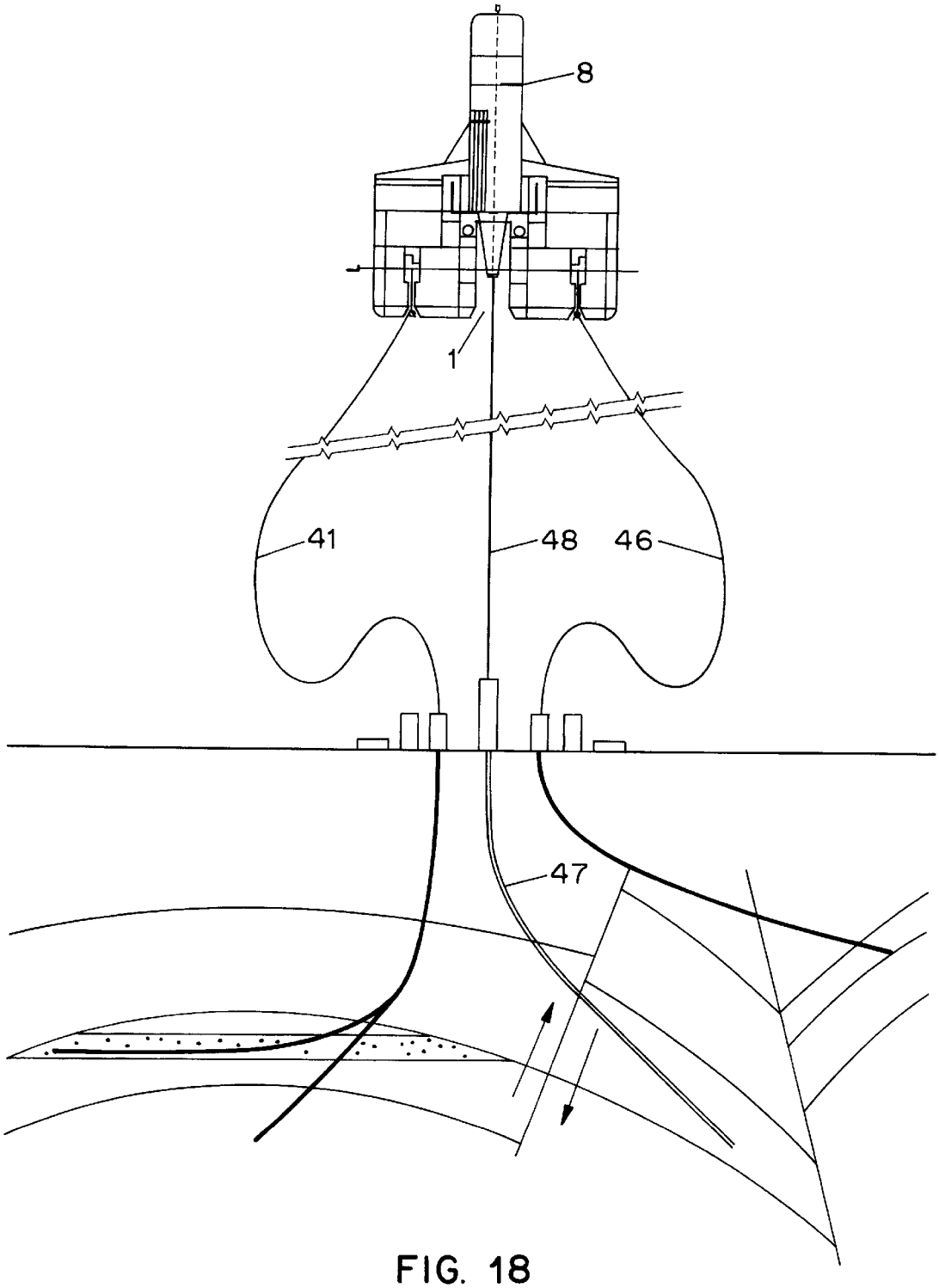

- FIG. 11 shows simultaneous cementing of a casing and handling of the drill assembly;
- FIG. 12 shows drilling with the drill assembly;
- FIG. 13 shows simultaneous cementing of a casing and lowering of a BOP;
- FIG. 14 shows simultaneous lowering of a wellhead Christmas tree and lifting of a BOP;
- FIG. 15 shows the installation of the wellhead Christmas tree whilst a completion string with a BOP is made ready;
- FIG. 16 shows the installation of a completion string;
- FIG. 17 shows test production from one well at the same time as a second well is drilled; and
- FIG. 18 shows production from two wells, via moonpools at the side of the main moonpool, whilst another well is drilled.

Figure 1:
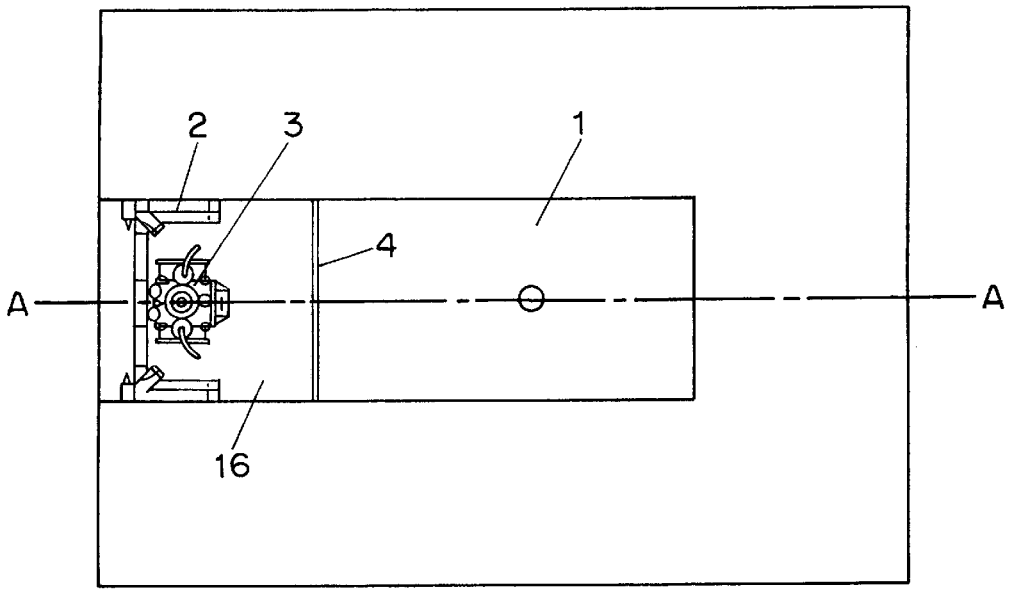
FIG. 1 shows a section of a drill and production ship seen from above with a dry dock according to the invention when closed and a lifting apparatus according to the invention inside the dry dock.

FIG. 1 is a schematic presentation of a section of a drill and production ship seen from above. The drill ship includes a large central moonpool 1. A lifting device 2 is provided in the moonpool 1, and is designed to support a load 3, which, e.g., may be a BOP (blow-out preventer). In the moonpool 1, there is provided a watertight bulkhead 4 which (as can be seen from FIG. 2) consists of two swing doors 5 and 6. The bulkhead 4 closes off a compartment 16. As can be seen from FIG. 6, the compartment 16 is closed off at the bottom by a floor 7. When the doors 5 and 6 are closed, they fit tightly against the floor 7 and the compartment 16 is watertight. A (non-illustrated) pump device is arranged to pump the water in the compartment 16 out, so that in actual fact the compartment functions as a dry dock.

Figure 6:
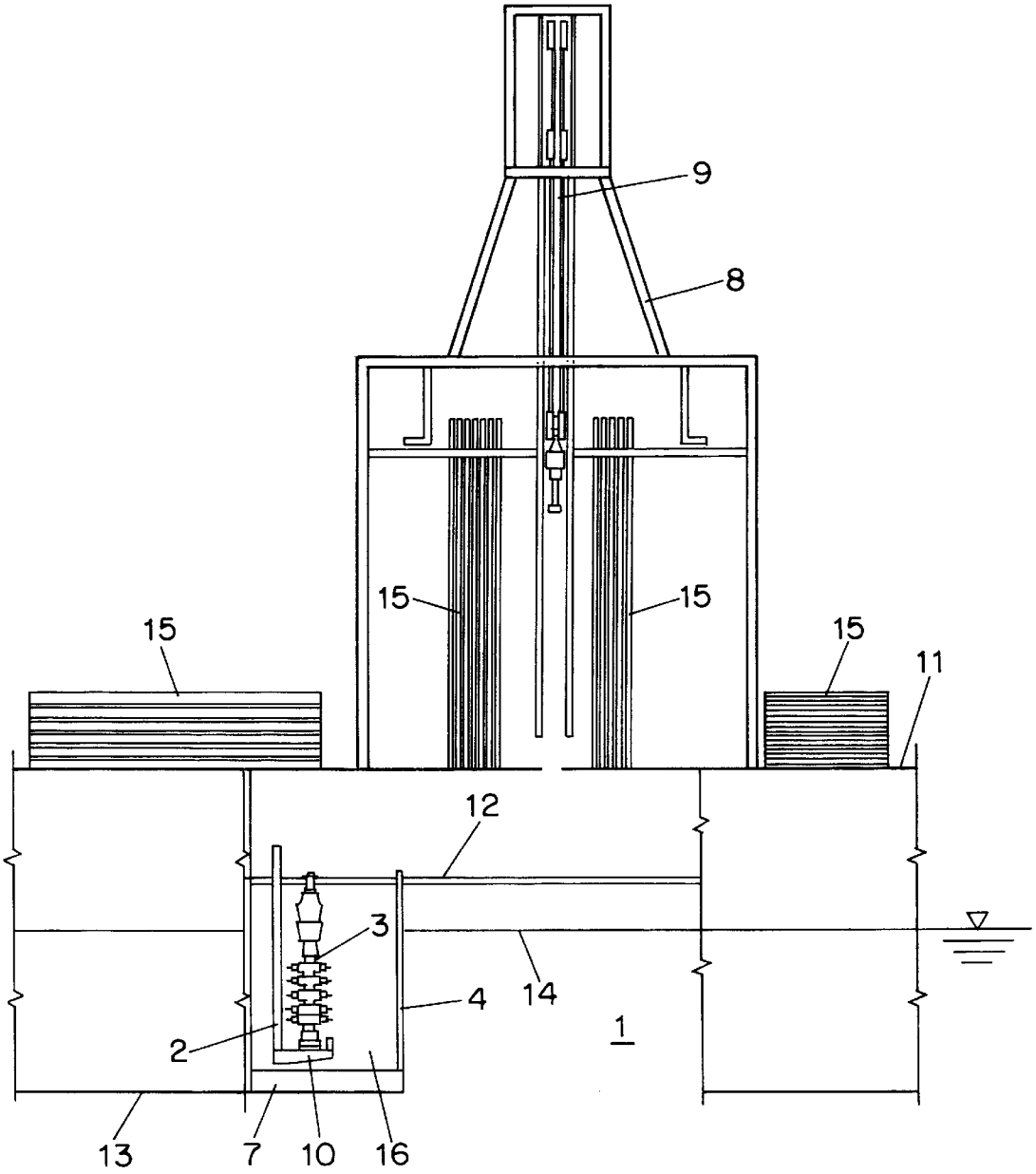
FIG. 6 is a sectional view along the line A—A in FIGS. 1–5 and corresponds to the situation in FIG. 1.
Figure 7:
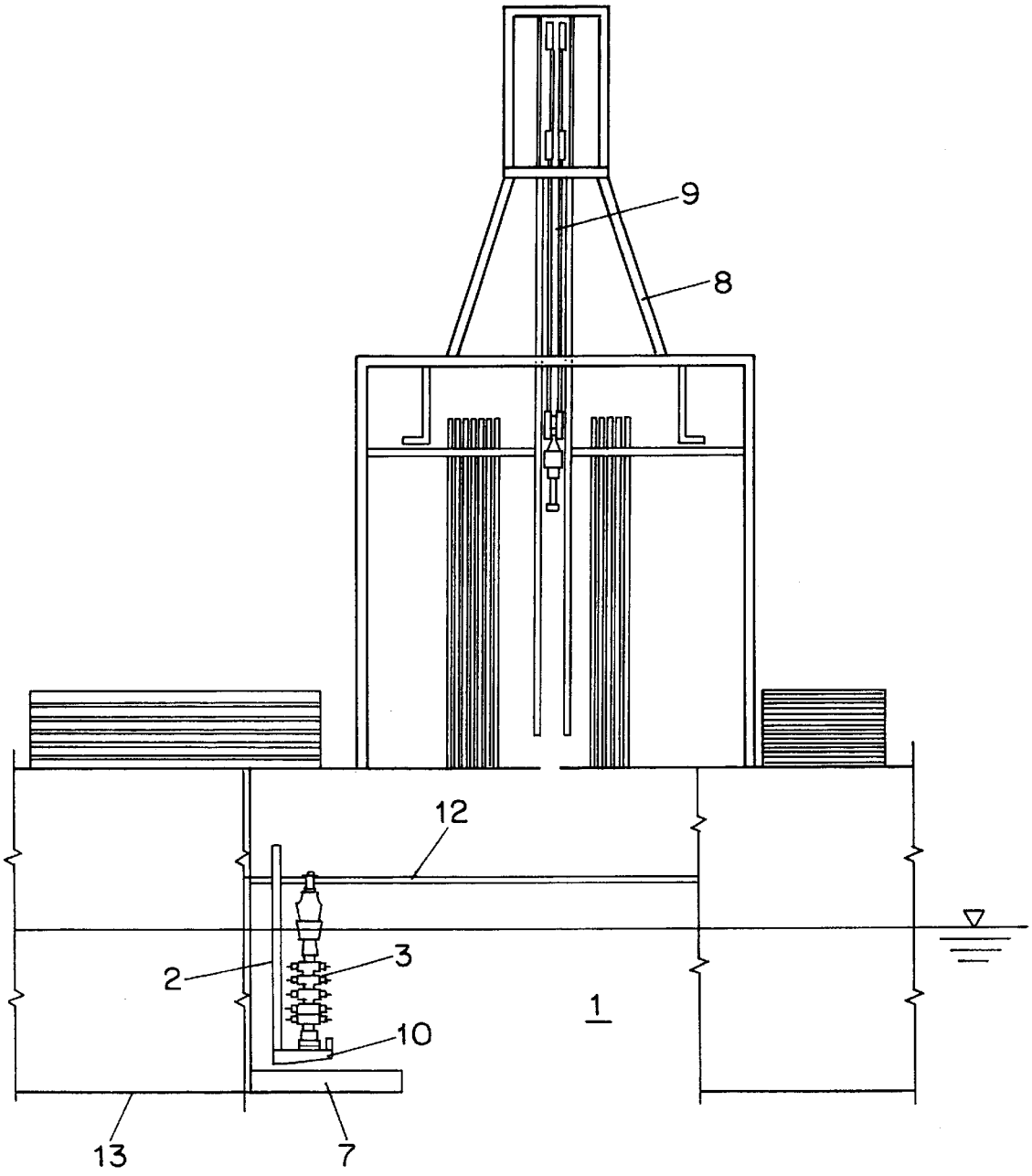
FIG. 7 is a sectional view along the line A—A in FIGS. 1–5 and corresponds to the situation in FIGS. 2 or 3.

FIG. 6 is a sectional view along the line A—A in FIG. 1. The moonpool 1 and the bulkhead 4 can also be seen in this figure. Above the moonpool 1 a derrick 8 is arranged, in which there is positioned a lifting apparatus 9. One or more pipe racks 15 are positioned on the ship's deck 11.

The lifting device 2 is seen from the side in FIG. 6. The lifting device includes a platform 10, on which it is possible to place a load 3. In one embodiment, the platform is capable of being raised and lowered vertically, to transport the load between the ship's deck 11 and the compartment 16 of the dry dock. The lifting device 2 is horizontally moveable along rails 12 which are secured to the walls of the dry dock.

The floor 7 of the dry dock is located close to the bottom 13 of the ship, thereby enabling the dry dock to be as deep as practically possible. This means that the dry dock is mostly below the level of the water line 14.

The function of the dry dock will be described in more detail with reference to FIGS. 1–10.

In FIGS. 1 and 6 the bulkhead 4 is closed in that the doors 5 and 6 have been swung to the closed position. The compartment 16 is emptied of water by means of the non-illustrated pump device. When the compartment 16 is emptied of water, a load 3 is made ready, which in the illustrated case is a BOP, on the lifting device platform 10. Since the compartment 16 is now dry, the preparation of the BOP is made easier, because (a) the view from the deck down to the load is improved considerably when the load is dry, (b) there is no need to take into account any danger of water penetration into easily damaged parts of the load 3 whilst it is being made ready, and (c) personnel enter the dry dock and work on the load 3 if the need arises.

Figure 2:
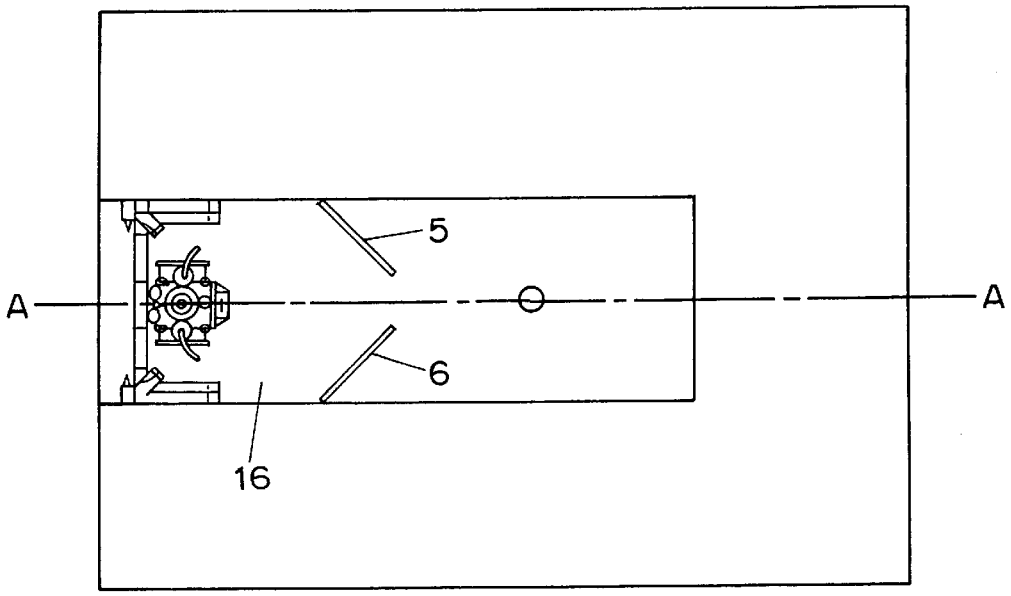
FIG. 2 shows a section of a drill and production ship seen from above with the dry dock according to the invention when partly open.
Figure 3:
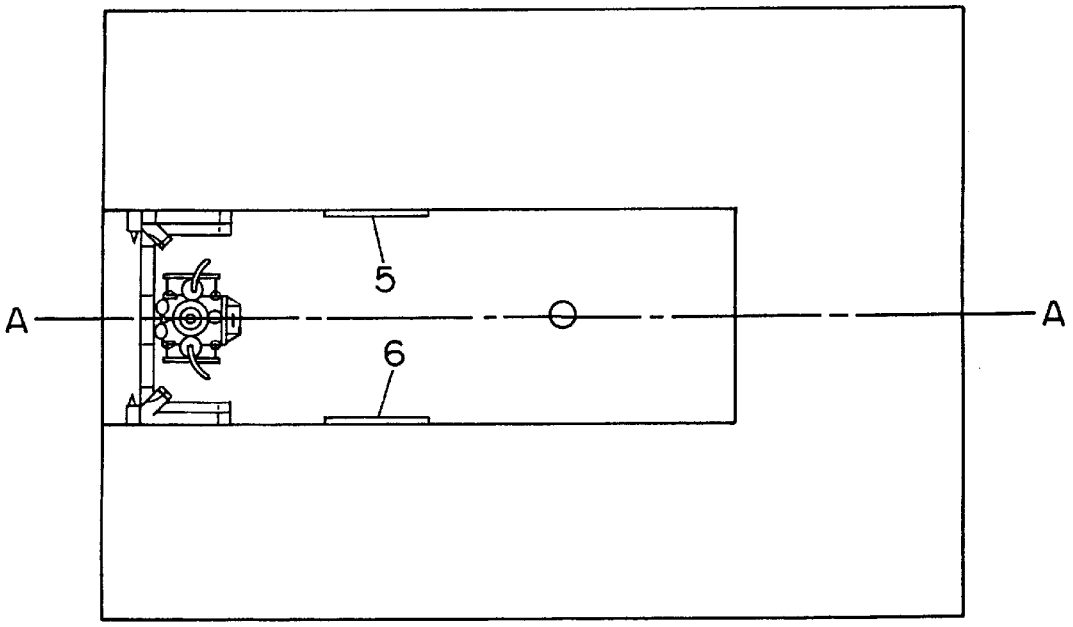
FIG. 3 shows a section of a drill and production ship seen from above with the dry dock according to the invention when fully open.

When the load 3 has been made ready, the doors 5 and 6 are opened. Before they are opened, and to make it easier to open the doors 5 and 6, the compartment should be filled fully or in part with water. In FIG. 2 the doors 5 and 6 are partly opened, and in FIGS. 3 and 7 the doors and swung right against the moonpool 1 walls. In the meanwhile, the lifting apparatus 9 in the derrick 8 has been made ready to receive the load 3, e.g., a BOP.

Figure 4:
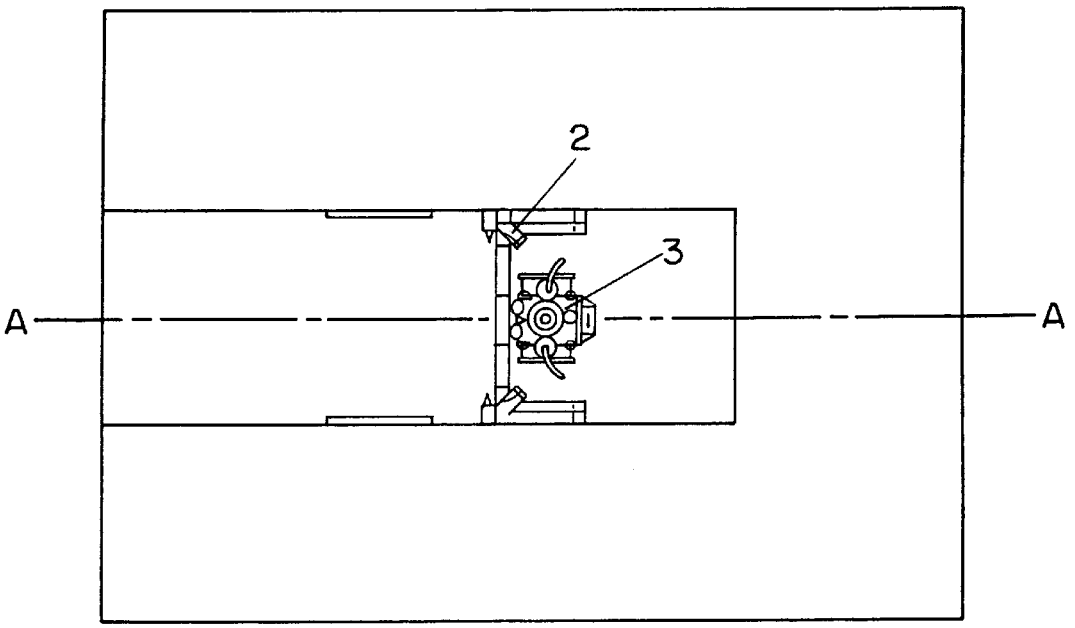
FIG. 4 shows a section of a drill and production ship seen from above with the dry dock according to the invention when fully open and the lifting apparatus according to the invention moved to a position outside the dry dock.
Figure 8:
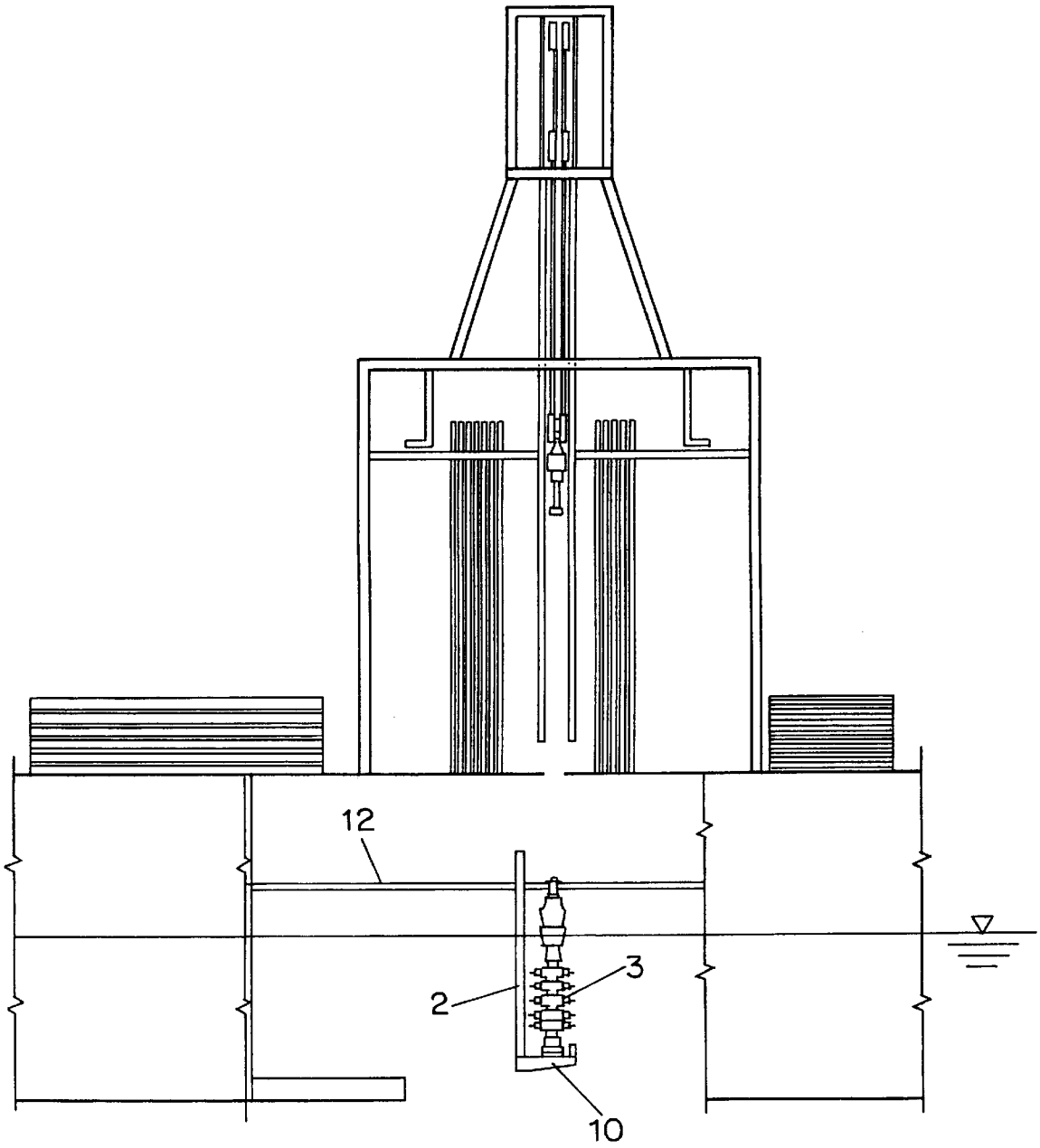
FIG. 8 is a sectional view along the line A—A in FIGS. 1–5 and corresponds to the situation in FIG. 4.

As can be seen from FIGS. 4 and 8, the lifting device 2 is now run along the rails 12 into a position outside the compartment 16 and under the derrick 8. To determine this position, the lifting device 2 platform 10 may be equipped with a marker (not shown) which is centred under the derrick 8 when the lifting device 2 reaches a predetermined position. This position may, e.g., be determined by an end stop switch (not shown). Advantageously, the lifting device may be locked in this position to prevent it from moving during the load transfer to the lifting apparatus 9 in the derrick 8.

Figure 5:
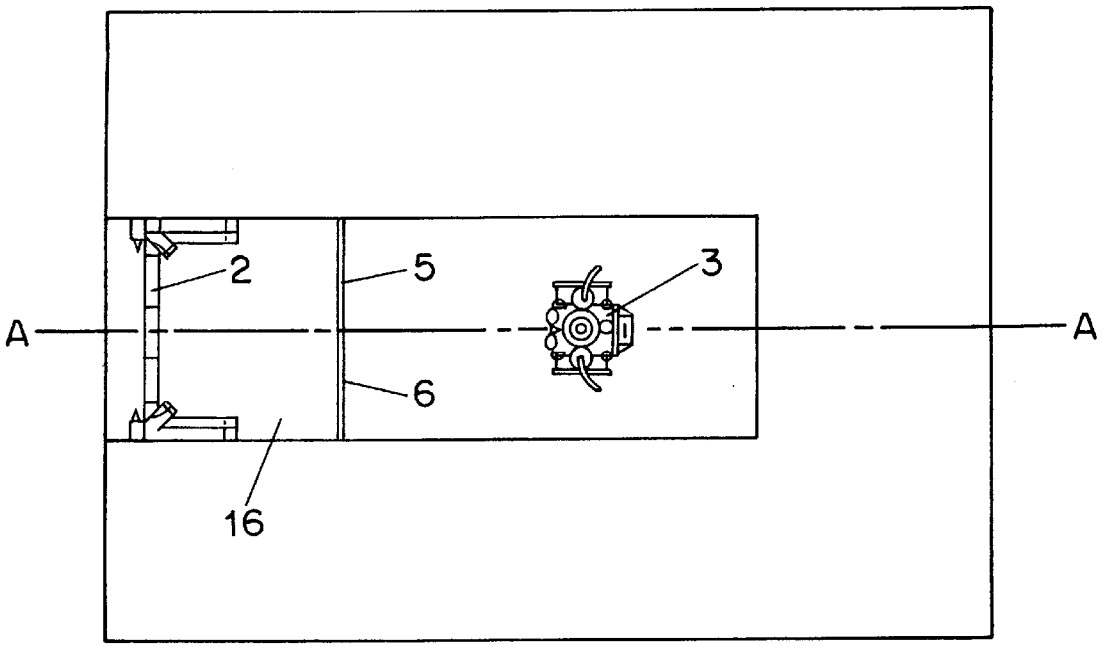
FIG. 5 shows a section of a drill and production ship seen from above with the dry dock according to the invention when fully open and the lifting apparatus according to the invention moved back into the dry dock.
Figure 9:
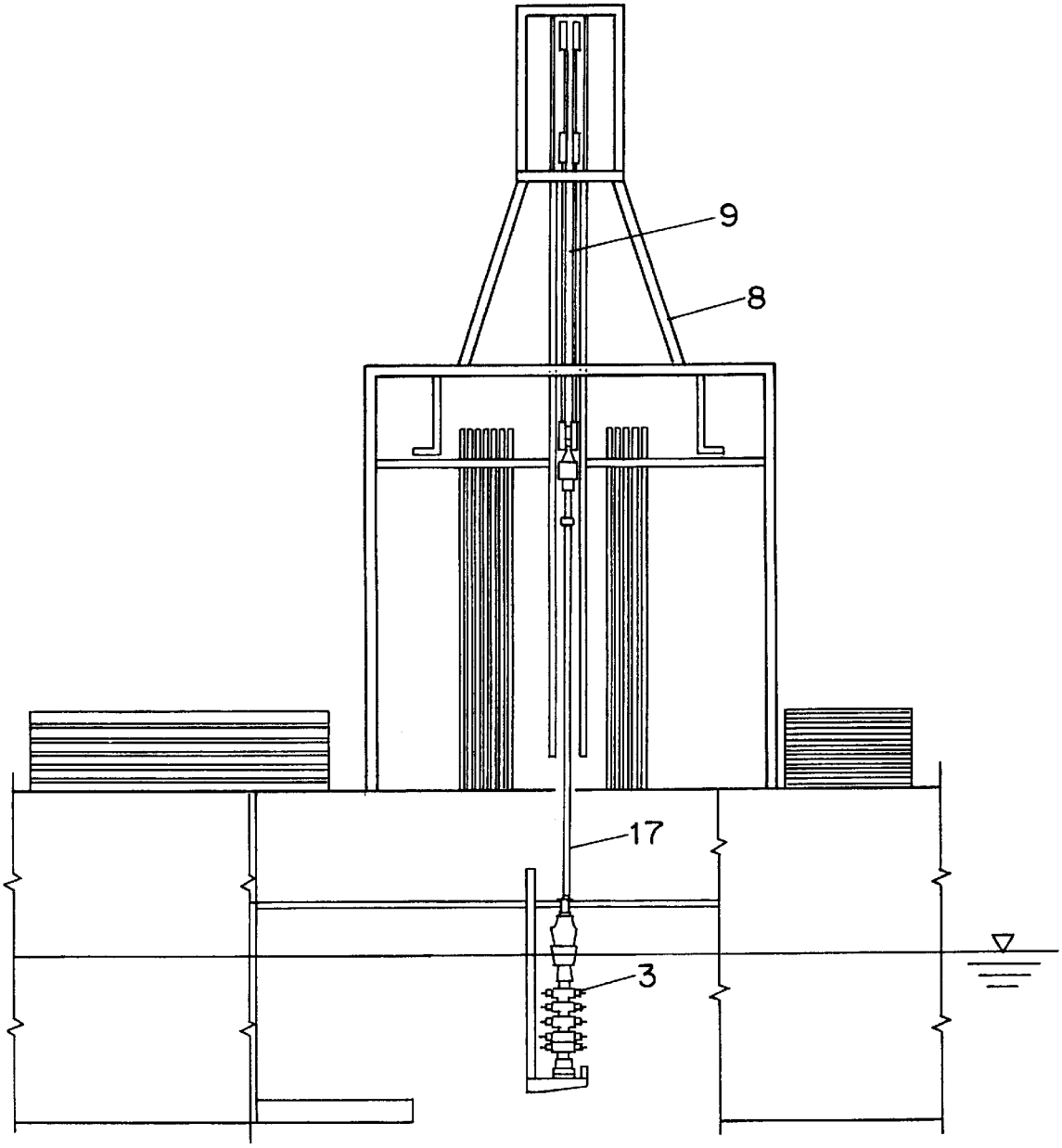
FIG. 9 is a sectional view along the line A—A in FIGS. 1–5 and corresponds to the situation in FIG. 4, but with a pipe string connected to the load of the lifting apparatus.
Figure 10:
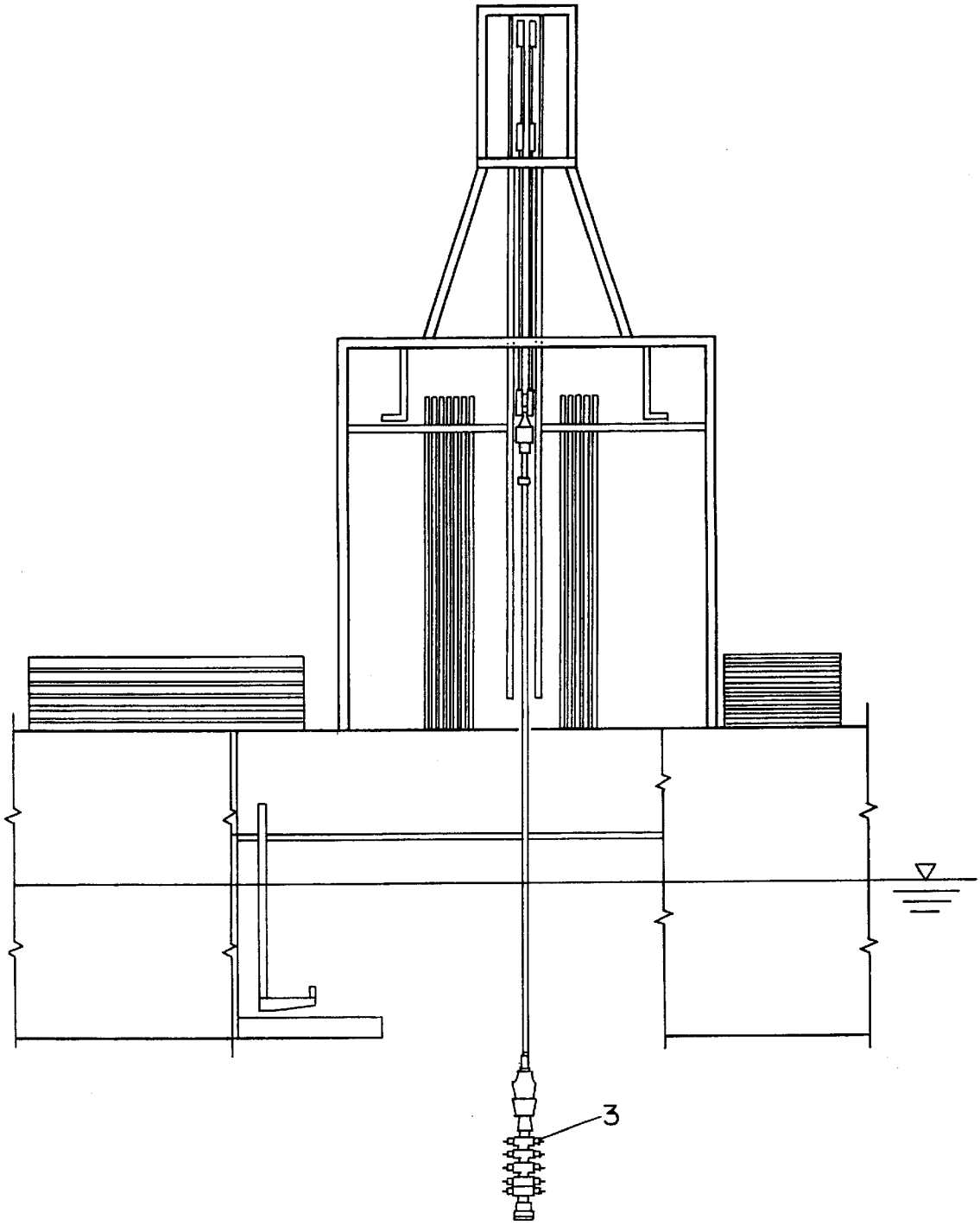
FIG. 10 is a sectional view along the line A—A in FIGS. 1–5 and corresponds to the situation in FIG. 5.

In FIGS. 5 and 9 the load 3 is connected to the derrick 8 lifting apparatus 9, e.g., via a pipe 17. In FIG. 9 the load 3 is still held by the lifting device 2, whilst in FIG. 5 the lifting device 2 has been moved back into the compartment 16, so that the load hangs freely from the lifting apparatus 9 in the derrick 8. The doors 5 and 6 can now be closed and the compartment 16 emptied of water so that a new load can be made ready. In FIG. 10 the load 3 is the process of being lowered in place on a subsea installation.

When a load is to be brought up from the seabed, it can be transferred to the dry dock. This is done by using the lifting apparatus 9 in the derrick 8 to lift the load 3 up to a position corresponding to the position of the load 3 in FIG. 9. The lifting device 2 is then moved out of the compartment 16 to a position corresponding to the position in FIG. 9. The load is detached from the derrick 8 lifting apparatus 9 and the lifting device 2 moves the load into the compartment 16. After the doors 5 and 6 have been closed and the compartment 16 emptied of water, e.g., maintenance can be carried out on the load whilst it is in the compartment 16, or the load can be brought up onto the ship's deck.

The dry dock can also be used without the lifting device, e.g., for launching or taking up a ROV or the like.

In an alternative embodiment, the floor 7 can be removed, by, e.g., drawing it into the ship, so that the whole moonpool can be used for the passage of equipment. This is particularly advantageous if a piece of equipment of large dimensions is to be passed through the moonpool.

FIGS. 11 to 18 show an example of a practical use of the drill and production ship according to the present invention.

In FIG. 11 the cementing of a casing 31 at the well top is about to be completed, at the same time as a drill string 32 with a drill bit 33 is being built up. The cementing of the casing 31 is handled by an auxiliary lifting apparatus 34, whilst the build-up of the drill string 32 is handled from the lifting apparatus 9 in the derrick 8. This is made possible primarily because of the size of the main moonpool I and the space that is freed in the proximity thereof, as mentioned above.

In FIG. 12, the cementing of the casing 31 is completed and the drilling with the drill string 32 has commenced. At the same time a BOP (blow-out preventer) 3 is made ready in the dry dock 16 on the lifting apparatus 10. The bulkhead 4 is now closed and the compartment 16 has been emptied of water.

In FIG. 13, another casing is cemented, which operation is handled from the lifting apparatus 9 of the derrick, whilst a second auxiliary lifting apparatus 36 is in the process of lowering the BOP 3, which has been made ready in advance on the lifting apparatus 2 behind the watertight bulkhead 4.

FIG. 14 shows a ready-drilled well 38 on which the BOP 3 is arranged. A wellhead Christmas tree 39 is in the process of being lowered down by the auxiliary lifting apparatus 34, whilst the BOP 3 is ready to be lifted by the derrick 8 lifting apparatus 9.

In FIG. 15 the wellhead Christmas tree 39 has been installed, whilst the BOP 3 is hanging ready next to it in the second auxiliary lifting device 36. Preparations for the construction of a completion string are now started in the derrick 8 lifting apparatus 9.

In FIG. 16 the BOP 3 has been lifted into place above the wellhead Christmas tree 39, and a completion string 40 has been run down into the well 38.

In FIG. 17 a production string 41 has been run down into the well by means of the auxiliary lifting apparatus 34, whilst the drilling of a new well 42 has commenced using a drill string 43. The drill string 43 is suspended from the derrick 8 lifting apparatus 9.

After the test production has been completed, the production riser 41 will then be transferred to the smaller moonpools located next to the main moonpool 1, as is shown in FIG. 18, so that normal production from the well can be carried out. In this figure a second riser 46 is also shown, and this is connected to a corresponding moonpool on the opposite side of the main moonpool 1. At the same time a third well 47 is drilled using a drill string 48, which runs through the main moonpool 1.

By using the invention described above it is thus possible to make use of a drill ship in a far more efficient manner than earlier. Of course, modifications and further developments obvious to a person versed in the art could be made within the scope of the patent claims below. E.g., the dry dock may be positioned in a different way in the moonpool and several dry docks could also be arranged in the same moonpool.

What is claimed is:

1. A floating installation, including a main moonpool, in which there is arranged a bulkhead which divides the moonpool into a first section and a second section, which bulkhead forms a first wall in a compartment in the first section, which compartment is also defined by the walls of the moonpool and a floor, which bulkhead is designed to be opened to provide communication between the first section and the second section, which compartment is substantially watertight when the bulkhead is closed, and in which a lifting device for carrying a load is provided so as to be moveable between a first position inside the compartment and a second position in the second section of the moonpool, wherein the floating installation has a derrick above the moonpool, the derrick having a vertical axis along which strings of pipe are moveable, and that the lifting device is movable along rails mounted in the moonpool straddling the vertical axis of the derrick, and running between the compartment and the second section, the load being transferable between the lifting device and a suspension in the string of the pipe.

2. A floating installation according to claim 1, wherein the lifting device has a platform for supporting equipment to be installed or retrieved.

3. A floating installation according to claim 1 or 2, wherein the lifting device includes a vertically moveable load-bearing part.

4. A floating installation according to claim 1, wherein the derrick is provided above the second section of the moonpool.

5. A floating installation according to claim 1, wherein the compartment is located beneath the main deck of the floating installation and essentially below the water line.

6. A floating installation according to claim 1, wherein the bulkhead includes two swing doors which swing doors are arranged to swing against the walls of the moonpool.

7. A floating installation according to claim 4, wherein the lifting device is equipped with a marker indicating the centring position of the lifting device under the derrick when the lifting device is in a predetermined position under the derrick, in which position the lifting device may be locked.

* * * * *

UNITED STATES PATENT AND TRADEMARK OFFICE

CERTIFICATE OF CORRECTION

PATENT NO. : 6,321,675 B1
DATED : November 27, 2001
INVENTOR(S) : Dybdahl et al.

It is certified that error appears in the above-identified patent and that said Letters Patent is hereby corrected as shown below:

Title page,
Item [57], ABSTRACT,
Line 7, "(I)" should read -- (1) --

Column 4,
Line 20, "apparatus 2" should read -- device 2 --

Column 5,
Line 4, "movable" should read -- moveable --

Column 6,
Line 11, "centring" should read -- centering --

Signed and Sealed this

Fifth Day of November, 2002

*Attest:*

*Attesting Officer*

JAMES E. ROGAN
*Director of the United States Patent and Trademark Office*